US010388231B2

(12) United States Patent
Zhou et al.

(10) Patent No.: US 10,388,231 B2
(45) Date of Patent: Aug. 20, 2019

(54) METHOD FOR CONTROLLING DISPLAY DEVICE, CONTROL APPARATUS FOR DISPLAY DEVICE AND DISPLAY DEVICE

(71) Applicant: BOE TECHNOLOGY GROUP CO., LTD., Beijing (CN)

(72) Inventors: Chengqi Zhou, Beijing (CN); Yifang Chu, Beijing (CN); Chengte Lai, Beijing (CN); Shou Li, Beijing (CN); Chulgyu Jung, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 84 days.

(21) Appl. No.: 15/547,042

(22) PCT Filed: Jan. 5, 2017

(86) PCT No.: PCT/CN2017/070260
§ 371 (c)(1),
(2) Date: Jul. 27, 2017

(87) PCT Pub. No.: WO2017/202036
PCT Pub. Date: Nov. 30, 2017

(65) Prior Publication Data

US 2018/0218690 A1 Aug. 2, 2018

(30) Foreign Application Priority Data

May 27, 2016 (CN) ..... 2016 1 0359385

(51) Int. Cl.
*G09G 3/34* (2006.01)

(52) U.S. Cl.
CPC ..... *G09G 3/3406* (2013.01); *G09G 2320/043* (2013.01); *G09G 2320/066* (2013.01);
(Continued)

(58) Field of Classification Search
CPC ..... G09G 3/3406; G09G 2320/043; G09G 2320/0626; G09G 2360/16; G09G 2320/066; G09G 2330/021
See application file for complete search history.

(56) References Cited

U.S. PATENT DOCUMENTS 8,896,638 B2 * 11/2014 Kurabayashi ..... G09G 3/3426 345/690
9,613,409 B1 * 4/2017 Tsai ..... G06T 5/009
(Continued)

FOREIGN PATENT DOCUMENTS

CN 104050934 A 9/2014
CN 105047142 A 11/2015
(Continued)

OTHER PUBLICATIONS

Office Action received for Chinese Patent Application No. 201610359385.X, dated Jan. 26, 2018, 16 pages (8 pages of English Translation and 8 pages of Office Action).
(Continued)

*Primary Examiner* — Ibrahim A Khan
(74) *Attorney, Agent, or Firm* — Womble Bond Dickinson (US) LLP

(57) ABSTRACT

The present disclosure provides a method for controlling a display device, a control apparatus for a display device, and a display device comprising the control apparatus. The method for controlling a display device may comprise the steps of: determining whether or not to perform peak driving for respective backlight sub-regions of the display device, the backlight sub-regions corresponding to sub-display areas of the display device; and performing, in response to a result of the above determining step, data signal compensation at least for sub-display areas whose average luminance values are lower than a preset first luminance threshold among the
(Continued)

sub-display areas to which the backlight sub-regions that are determined to be subjected to peak driving correspond.

14 Claims, 3 Drawing Sheets

(52) U.S. Cl.
CPC ..... *G09G 2320/0626* (2013.01); *G09G 2330/021* (2013.01); *G09G 2360/16* (2013.01)

(56) References Cited

U.S. PATENT DOCUMENTS

| | | | | |
|---|---|---|---|---|
| 9,773,459 | B2 * | 9/2017 | Ikeda | G09G 3/3426 |
| 2009/0289968 | A1 * | 11/2009 | Yoshida | G09G 3/2025 345/691 |
| 2010/0182346 | A1 | 7/2010 | Sano et al. | |
| 2010/0245397 | A1 | 9/2010 | Choe et al. | |
| 2012/0007896 | A1 * | 1/2012 | Kwon | G09G 3/3426 345/690 |
| 2012/0139885 | A1 * | 6/2012 | Iwasa | G09G 3/3426 345/207 |
| 2013/0314459 | A1 * | 11/2013 | Nakanishi | G09G 3/3406 345/694 |
| 2014/0327704 | A1 | 11/2014 | Wei et al. | |
| 2015/0116389 | A1 * | 4/2015 | Watanabe | G09G 3/3426 345/694 |
| 2015/0348471 | A1 | 12/2015 | Meng et al. | |
| 2016/0155372 | A1 * | 6/2016 | Ikeda | G09G 3/3426 345/589 |
| 2017/0061896 | A1 | 3/2017 | Zhang et al. | |
| 2017/0061901 | A1 | 3/2017 | Zhang et al. | |
| 2017/0061902 | A1 * | 3/2017 | Zhang | G09G 3/3426 |

FOREIGN PATENT DOCUMENTS

| | | | |
|---|---|---|---|
| CN | 105185327 | A | 12/2015 |
| CN | 105185328 | A | 12/2015 |
| CN | 106023905 | A | 10/2016 |

OTHER PUBLICATIONS

International Search Report and Written Opinion in PCT/CN2017/070260 dated Mar. 15, 2017, with English translation.

* cited by examiner

METHOD FOR CONTROLLING DISPLAY DEVICE, CONTROL APPARATUS FOR DISPLAY DEVICE AND DISPLAY DEVICE

RELATED APPLICATION

The present application is the U.S. national phase entry of PCT/CN2017/070260, with an international filling date of Jan. 5, 2017, which claims the benefit of Chinese Patent Application NO. 201610359385.X, filed on May 30, 2016, the entire disclosure of which is incorporated herein by reference.

FIELD OF THE INVENTION

The present disclosure relates to the field of display technology, and more particularly to a method for controlling a display device, a control apparatus for a display device, and a display device comprising the control apparatus.

BACKGROUND

In the prior art, a local backlight adjustment method is often used for the control of a display device such as a liquid crystal display, in order to reduce the power consumption of the display device, enhance the contrast of the displayed image, reduce the image retention, etc. This local backlight adjustment method actually divides the backlight of the display device into multiple backlight sub-regions, and then controls respective backlight sub-regions independently. On this basis, the peak driving technique can be further combined, that is, peak driving is performed for some backlight sub-regions such that these backlight sub-regions reach possible maximum luminance so as to make the details of the displayed image clearer and further enhance the contrast of the displayed image.

SUMMARY

The inventors of the present application have found that, after peak driving is performed for some backlight sub-regions of the display device, it is likely to make the sub-display areas of the display panel of the display device to which these backlight sub-regions correspond look too bright, which causes a large visual brightness difference between these sub-display areas and adjacent sub-display areas to which the backlight sub-regions not subjected to peak driving correspond. Particularly during the low gray scale period, the human eyes' perception of a luminance variation is more sensitive, such visual brightness difference may be more significant. In other words, the luminance uniformity of the image displayed by the display device may be decreased, thereby affecting the visual effect of the displayed image.

In view of the above, an embodiment of the present disclosure proposes a method for controlling a display device. The method may comprise steps of: determining whether or not to perform peak driving for respective backlight sub-regions of the display device, the backlight sub-regions corresponding to sub-display areas of the display device; and performing, in response to a result of the above determining step, data signal compensation at least for sub-display areas whose average luminance values are lower than a preset first luminance threshold among the sub-display areas to which the backlight sub-regions that are determined to be subjected to peak driving correspond.

In some embodiments, whether peak driving is performed for backlight sub-regions to which respective sub-display areas of the display device correspond may be determined based on average luminance of the respective sub-display areas or a number of pixels included by the respective sub-display areas whose luminance exceed a preset second luminance threshold.

In some embodiments, the step of determining whether or not to perform peak driving for respective backlight sub-regions of the display device may comprise: counting a number of pixels included in each sub-display area whose luminance exceed the second luminance threshold; calculating an average luminance value of each sub-display area; determining backlight sub-regions to be subjected to peak driving based on a result of the above counting step or calculating step.

In some embodiments, the method may comprise: determining that peak driving is performed for backlight sub-regions to which a first sub-display area, a second sub-display area and a third sub-display area of the display device correspond, the first sub-display area has an average luminance value greater than the preset first luminance threshold and includes N1 pixels whose luminance exceed the second luminance threshold, N1 being greater than a preset number threshold N0; the second sub-display area has an average luminance value greater than the first luminance threshold and includes N2 pixels whose luminance exceed the second luminance threshold, N2 being smaller than the preset number threshold N0; the third sub-display area has an average luminance value smaller than the first luminance threshold and includes N3 pixels whose luminance exceed the second luminance threshold, N3 being greater than the preset number threshold N0.

In some embodiments, the method may comprise: compensating a data signal to the third sub-display area by a first data signal compensation circuit so as to adjust light transmittance of the third sub-display area.

In some embodiments, for a data signal D of the third sub-display area which is smaller than a preset data signal threshold $D_t$, the data signal D is adjusted to $D/K_1$ by the first data signal compensation circuit; for a data signal D of the third sub-display area which is greater than the data signal threshold $D_t$, the data signal D is adjusted to $$\frac{\frac{D_t}{K_1} - A}{D_t - A}(D - A) + A$$

by the first data signal compensation circuit, where A represents the highest gray scale of a displayed image of the display device; the value $K_1$ is obtained by the following equation:

$$BL_1 = BL_0 \cdot K_1^{\gamma}$$

where $BL_1$ is a backlight luminance of a backlight sub-region corresponding to the third sub-display area after backlight adjustment, $BL_0$ is a default backlight luminance of a backlight sub-region corresponding to any sub-display area of the display device without backlight adjustment, and $\gamma$ is a physical parameter of the display device which characterizes a distortion of an output image with respect to an input signal.

In some embodiments, the method may further comprise: performing data signal compensation for sub-display areas of the display device to which backlight sub-regions not subjected to peak driving correspond.

In some embodiments, the sub-display areas to which backlight sub-regions not subjected to peak driving correspond may include a fourth sub-display area, the fourth sub-display area having an average luminance value smaller than the first luminance threshold and including N4 pixels whose luminance exceed the second luminance threshold, N4 being smaller than the preset number threshold N0. The method may further comprise: compensating a data signal to the fourth sub-display area by a second data signal compensation circuit so as to adjust light transmittance of the fourth sub-display area.

In some embodiments, a data signal D of the fourth sub-display area is adjusted to $D/K_2$ by the second data signal compensation circuit, $K_2$ is obtained by the following equation:

$$BL_2=BL_0 \cdot K_2^{\gamma}$$

where $BL_2$ is a backlight luminance of a backlight sub-region corresponding to the fourth sub-display area after backlight adjustment, $BL_0$ is a default backlight luminance of a backlight sub-region corresponding to any sub-display area of the display device without backlight adjustment, and $\gamma$ is a physical parameter of the display device which characterizes a distortion of an output image with respect to an input signal.

In some embodiments, the step of determining whether or not to perform peak driving for respective backlight sub-regions of the display device may further comprise: calculating a power P1 required for peak driving of a backlight sub-region that is determined to be subjected to peak driving; comparing the required power P1 with a power threshold P0; when the required power P1 is smaller than the power threshold P0, peak driving is performed for the backlight sub-region that is determined to be subjected to peak driving, and the power threshold P0 is a power difference between a rated power or a maximum power of the display device and a power required by the display device for displaying a one-frame image.

Another embodiment of the present disclosure provides control apparatus for a display device. The control apparatus may comprise: a peak driving circuit disposed in a backlight module for determining whether or not to perform peak driving for respective backlight sub-regions and performing peak driving for a backlight sub-region that is determined to be subjected to peak driving, the backlight sub-regions corresponding to sub-display areas of the display device; and a data signal compensation circuit disposed in a display panel for performing, based on a determination result of the peak driving circuit, data signal compensation at least for sub-display areas whose average luminance values are lower than a preset first luminance threshold among the sub-display areas to which the backlight sub-regions that are determined to be subjected to peak driving correspond.

In some embodiments, the peak driving circuit may determine whether or not to perform peak driving for backlight sub-regions to which respective sub-display areas of the display device correspond based on average luminance of the respective sub-display areas or a number of pixels included by the respective sub-display areas whose luminance exceed a preset second luminance threshold.

In some embodiments, the peak driving circuit may comprise: a statistics module for counting a number of pixels included in each sub-display area whose luminance exceed the second luminance threshold; an average luminance value calculation module for calculating an average luminance value of each sub-display area; a determination module for determining backlight sub-regions to be subjected to peak driving based on a result of the statistics module or the average luminance value calculation module.

In some embodiments, the determination module may determine that peak driving is performed for backlight sub-regions to which a first sub-display area, a second sub-display area and a third sub-display area of the display device correspond, the first sub-display area has an average luminance value greater than the preset first luminance threshold and includes N1 pixels whose luminance exceed the second luminance threshold, N1 being greater than a preset number threshold N0; the second sub-display area has an average luminance value greater than the first luminance threshold and includes N2 pixels whose luminance exceed the second luminance threshold, N2 being smaller than the preset number threshold N0; the third sub-display area has an average luminance value smaller than the first luminance threshold and includes N3 pixels whose luminance exceed the second luminance threshold, N3 being greater than the preset number threshold N0.

In some embodiments, the data signal compensation circuit may comprise: a first data signal compensation circuit for compensating a data signal to the third sub-display area so as to adjust light transmittance of the third sub-display area.

In some embodiments, for a data signal D of the third sub-display area which is smaller than a preset data signal threshold $D_t$, the first data signal compensation circuit adjusts the data signal D to $D/K_1$; for a data signal D of the third sub-display area which is greater than the data signal threshold $D_t$, the first data signal compensation circuit adjusts the data signal D to $$\frac{\frac{D_t}{K_1}-A}{D_t-A}(D-A)+A$$

A represents the highest gray scale of a displayed image of the display device; the value $K_1$ is obtained by the following equation:

$$BL_1=BL_0 \cdot K_1^{\gamma}$$

$BL_1$ is a backlight luminance of a backlight sub-region corresponding to the third sub-display area after backlight adjustment, $BL_0$ is a default backlight luminance of a backlight sub-region corresponding to any sub-display area of the display device without backlight adjustment, and $\gamma$ is a physical parameter of the display device which characterizes a distortion of an output image with respect to an input signal.

In some embodiments, the data signal compensation circuit may further perform data signal compensation for sub-display areas of the display device to which backlight sub-regions not subjected to peak driving correspond.

In some embodiments, the sub-display areas to which backlight sub-regions not subjected to peak driving correspond may include a fourth sub-display area, the fourth sub-display area has an average luminance value smaller than the first luminance threshold and includes N4 pixels whose luminance exceed the second luminance threshold, N4 being smaller than the preset number threshold N0, the data signal compensation circuit comprises a second data signal compensation circuit for compensating a data signal to the fourth sub-display area so as to adjust light transmittance of the fourth sub-display area.

In some embodiments, the second data signal compensation circuit may adjust the data signal D of the fourth sub-display area to $D/K_2$, $K_2$ is obtained by the following equation:

$$BL_2=BL_0 \cdot K_2^{\gamma}$$

$BL_2$ is a backlight luminance of a backlight sub-region corresponding to the fourth sub-display area after backlight adjustment, $BL_0$ is a default backlight luminance of a backlight sub-region corresponding to any sub-display area of the display device without backlight adjustment, and $\gamma$ is a physical parameter of the display device which characterizes a distortion of an output image with respect to an input signal.

In some embodiments, the peak driving circuit may further comprise: a power calculation module for calculating a power P1 required for peak driving of a backlight sub-region that is determined to be subjected to peak driving; a comparison module for comparing the required power P1 with a power threshold P0. When the required power P1 is smaller than the power threshold P0, the peak driving circuit performs peak driving for the backlight sub-region that is determined to be subjected to peak driving, and the power threshold P0 is a power difference between a rated power or a maximum power of the display device and a power required by the display device for displaying a one-frame image.

A further embodiment of the present disclosure provides a display device that may comprise the control apparatus described in any one of the preceding embodiments regarding the control apparatus.

BRIEF DESCRIPTION OF THE DRAWINGS

Embodiments of the present disclosure will be described in more detail below by way of non-limiting example with reference to the accompanying drawings so as to provide a thorough understanding of the principles and spirit of the present disclosure.

DETAILED DESCRIPTION OF EMBODIMENTS

Figure 1:
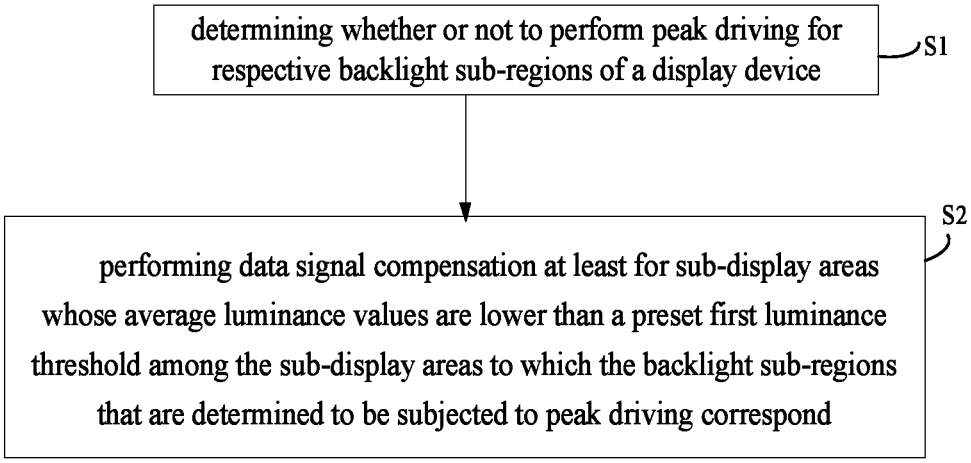
FIG. 1 illustrates a flow chart of a method for controlling a display device according to an embodiment of the present disclosure.

Hereinafter, specific embodiments of the present disclosure will be described in detail by way of examples. It is to be understood that the embodiments of the present invention are not limited to the examples set forth below, and modifications and variations can be made by those skilled in the art to the described embodiments under the principles or spirit revealed by the present disclosure, so as to obtain other different embodiments. Apparently, these embodiments all fall within the scope of the present invention.

In addition, it is to be noted that the drawings referred to herein are for the purpose of illustrating and explaining the embodiments of the present disclosure, each module or circuit embodied in the drawings is not necessarily an actual circuit configuration, and the connections between different modules or circuits are merely used for illustrating the embodiments of the present disclosure, which are not to be construed as limiting the scope of the present invention.

FIG. 1 illustrates a flow chart of a method for controlling a display device according to an embodiment of the present disclosure. In this embodiment, as shown in FIG. 1, the method may comprise the following steps. S1, determining whether or not to perform peak driving for respective backlight sub-regions of a display device, which backlight sub-regions correspond to sub-display areas of the display device; S2, performing, in response to the result of the above determining step, data signal compensation at least for sub-display areas whose average luminance values are lower than a preset first luminance threshold among the sub-display areas to which the backlight sub-regions that are determined to be subjected to peak driving correspond.

Figure 5:
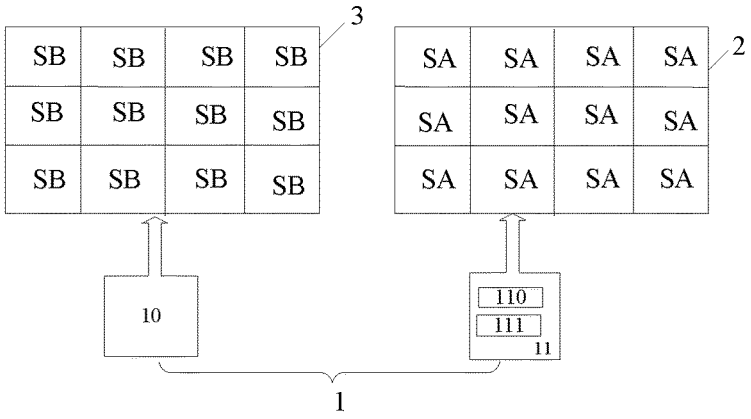
FIG. 5 illustrates a block diagram of a control apparatus, a display panel, and a backlight module of a display device according to an embodiment of the present disclosure.

Examples of the display device mentioned herein include, but are not limited to, a liquid crystal display. Referring to FIG. 5, the display device may comprise a display panel 2 and a backlight module 3. In terms of controlling the display panel 2, the display area of the display panel 2 can be divided into a plurality of sub-display areas SAs, accordingly, the backlight module 3 of the display device can be divided into a plurality of backlight sub-regions SBs corresponding to the sub-display areas SAs. It is possible to drive the backlight sub-regions SBs corresponding to respective sub-display areas SAs independently to realize local backlight adjustment. In addition, the method provided by the embodiment of the present disclosure may apply a peak driving technique to the display device. Peak driving mentioned herein means providing the light emitting elements in some backlight sub-regions SBs of the display device with a tolerable maximum driving current. For example, if a conventional current for driving the light emitting element in the backlight module of a liquid crystal display is, for example, approximately 200 mA, the driving current applied to the light emitting element of a certain backlight sub-region can be raised, within the range the light emitting element of the backlight module can withstand, to a large peak, for example, 400 mA, thereby enabling the sub-display area SA corresponding to that backlight sub-region to reach a greater luminance.

The inventors of the present application recognize that the visual brightness of a sub-display area SA depends mainly on the light transmittance of the sub-display area SA and the luminance of the backlight sub-region SB corresponding to the sub-display area SA. Meanwhile, the light transmittance of the sub-display area SA is in turn dependent on the deflection angle of the light valve such as a liquid crystal molecule influenced by an applied electric field, which is directly related to the data signal supplied to the sub-display area. Therefore, the visual brightness of the sub-display area can be changed by adjusting the data signal for the sub-display area. After peak driving is performed for the backlight sub-regions to which some sub-display areas of the display device correspond, it is likely to make the originally dark sub-display areas (e.g., sub-display areas having an average luminance value lower than the preset first luminance threshold) look too bright, which causes a large brightness difference between these sub-display areas and the sub-display areas to which the backlight sub-regions not subjected to peak driving correspond, and may reduce the luminance uniformity of the overall displayed image of the display device. However, with the method provided by the present embodiment, since data signal compensation can be performed at least for sub-display areas whose average luminance values are lower than the preset first luminance threshold among the sub-display areas to which the backlight sub-regions determined to be subjected to peak driving correspond, the data signals supplied to the corresponding sub-display areas can be adjusted so as to adjust the light transmittances of these sub-display areas, such that it becomes possible to reduce the luminance difference between different sub-display areas. Therefore, the method for controlling the display device provided by the embodiment of the present disclosure can not only achieve the advantages and effects of applying the local backlight adjustment and the peak driving technique, but also improve the uniformity of the overall luminance of the displayed image of the display device.

In some embodiments, the current luminance levels of respective sub-display areas may be taken into account upon determining whether or not to perform peak driving for respective backlight sub-regions of the display device. For example, it is possible to determine whether or not to perform peak driving for backlight sub-regions to which respective sub-display areas of the display device correspond based on average luminance of the respective sub-display areas or the number of pixels included by the respective sub-display areas whose luminance exceed a preset second luminance threshold. In this case, a pixel whose luminance exceeds the preset second luminance threshold may be referred to as a pixel that meets the peak driving conditions. For example, the maximum luminance value of a certain pixel is 255. If the current luminance value thereof is greater than 200, the pixel can be considered as a pixel that meets the peak driving conditions. For example, if a certain sub-display area has a relatively high average luminance level or includes a large number of pixels that meet the peak driving conditions, it may be considered that such a sub-display area can be raised to a higher luminance level, or it is reasonable to select the backlight sub-region to which such a sub-display area corresponds for peak driving, because the current overall luminance level of such a sub-display area is closer to the desired maximum luminance than the other sub-display areas.

Figure 2:
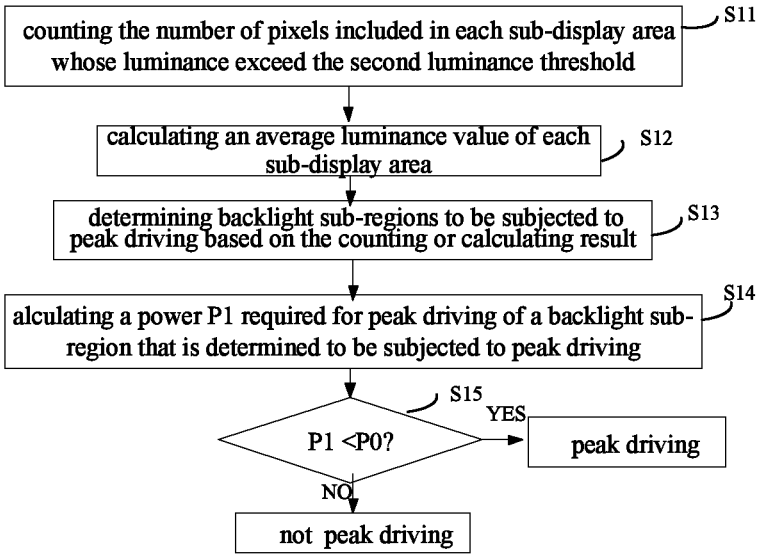
FIG. 2 illustrates a flow chart of determining whether or not to perform peak driving for respective backlight sub-regions of the display device according to an embodiment of the present disclosure.

In some embodiments, as shown in FIG. 2, the above-mentioned step of determining whether or not to perform peak driving for respective backlight sub-regions of the display device may include the steps of: S11, counting the number of pixels included in each sub-display area whose luminance exceeds the second luminance threshold; S12, calculating an average luminance value of each sub-display area; S13, determining backlight sub-regions to be subjected to peak driving based on the result of the above counting step or calculating step. It is to be understood that the second luminance threshold may be numerically equal to or may not be equal to the first luminance threshold.

In some embodiments, the method for controlling the display device may comprise determining that peak driving is performed for backlight sub-regions to which a first sub-display area, a second sub-display area and a third sub-display area of the display device correspond, the first sub-display area has an average luminance value greater than the preset first luminance threshold and includes N1 pixels whose luminance exceed the second luminance threshold, N1 being greater than a preset number threshold N0; the second sub-display area has an average luminance value greater than the first luminance threshold and includes N2 pixels whose luminance exceed the second luminance threshold, N2 being smaller than the preset number threshold N0; the third sub-display area has an average luminance value smaller than the first luminance threshold and includes N3 pixels whose luminance exceed the second luminance threshold, N3 being greater than the preset number threshold N0. That is, in this embodiment, the sub-display area whose average luminance value is greater than the preset first luminance threshold or the sub-display area in which the number of pixels whose luminance exceed the second luminance threshold is larger than the number threshold N0 is determined as a sub-display area whose corresponding backlight sub-region is to be subjected to peak driving. As described above, it is reasonable to select the backlight sub-region to which such a sub-display area corresponds for peak driving because the current overall luminance level of such a sub-display area is closer to the desired maximum luminance.

In some embodiments, the method for controlling the display device may comprise compensating the data signal for the third sub-display area by a first data signal compensation circuit so as to adjust the light transmittance of the third sub-display area.

In some embodiments, for a data signal D for the third sub-display area which is smaller than a preset data signal threshold $D_t$, the data signal D is adjusted to $D/K_1$ by the first data signal compensation circuit. For a data signal D for the third sub-display area which is greater than the data signal threshold $D_t$, the data signal D is adjusted to $$\frac{\frac{D_t}{K_1} - A}{D_t - A}(D - A) + A$$

by the first data signal compensation circuit, where A represents the highest gray scale of a displayed image of the display device, the value $K_1$ is obtained by the following equation:

$$BL_1 = BL_0 \cdot K_1^{\gamma}$$

where $BL_1$ is a backlight luminance of a backlight sub-region corresponding to the third sub-display area after backlight adjustment, $BL_0$ is a default backlight luminance of a backlight sub-region corresponding to any sub-display area of the display device without backlight adjustment, and $\gamma$ is a physical parameter of the display device which characterizes a distortion of an output image with respect to an input signal. $\gamma$ may vary depending on the types or models of different display devices, for example, $\gamma$ may be equal to 2.2, 2.5, and so on. It is to be understood that the phrase "backlight adjustment" as mentioned herein refers to employing dimming methods to perform luminance adjustment for the backlight sub-regions to which relevant sub-display areas (e.g. the third sub-display area and the fourth sub-display area mentioned below) correspond. The dimming methods include local backlight adjustment and peak driving as mentioned herein.

The data signal $D_{new}$ for the third sub-display area of the display device which has been adjusted by the first data signal compensation circuit can be represented by the following formula:

$$D_{new} = \begin{cases} D/K_1 & D < D_t \\ \frac{D_t}{K_1} - A & \\ \frac{D_t}{D_t - A}(D - A) + A & D > D_t \end{cases}$$

The data signal threshold $D_t$ may be a preset value much smaller than the maximum data signal value. In the case of performing peak driving for the backlight sub-region to which the third sub-display area corresponds, when the data signal D for the third sub-display area is smaller than the data signal threshold $D_t$, i.e. during the low gray scale period, the adjusted data signal $D_{new}$ (i.e. $D/K_1$) can be reduced compared to the original data signal D. Therefore, at that time, the light transmittance of the third sub-display area can be reduced to some extent, so that the visual brightness of the third sub-display area during the low gray scale period may maintain or be close to the original luminance level thereof, thereby improving the luminance uniformity between the third sub-display area and the sub-display area to which the backlight sub-region not subjected to peak driving corresponds during the low gray scale period. In addition, when the data signal D is greater than the data signal threshold $D_t$, i.e. during the high gray scale period, since the sensitivity of the human eyes to a perceived luminance variation is not as good as that during the low gray scale period, the adjusted data signal $D_{new}$ at that time may be larger than the adjusted data signal (i.e. $D/K_1$) during the low gray scale period, or even larger than the original data signal D, so that the third sub-display area exhibits a high luminance to achieve the advantages and effects by peak driving.

Figure 3:
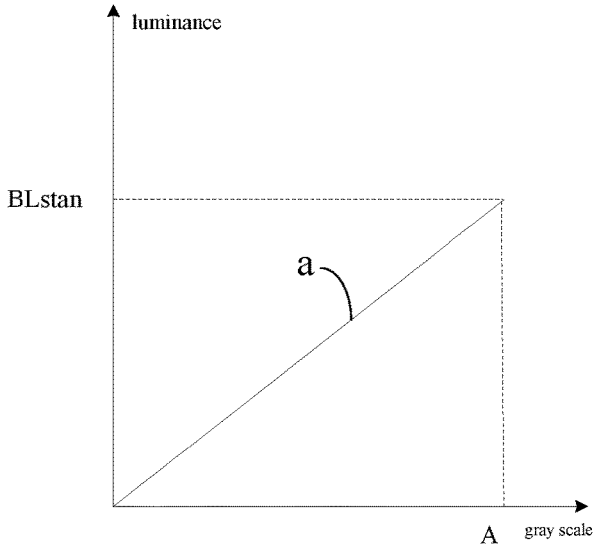
FIGS. 3 and 4 illustrate a plurality of curves representing the relationship between the gray scale (data signal) and the luminance of the display device.
Figure 4:
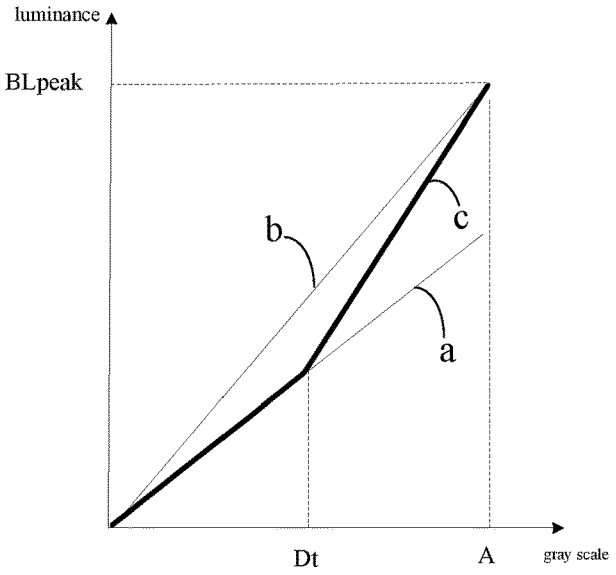

For example, FIGS. 3 and 4 illustrate a plurality of curves representing the relationship between the gray scale (data signal) and the luminance, the curve a in FIG. 3 schematically represents the relationship between the gray scale and the luminance when dimming is not performed (i.e. peak driving is not performed for the corresponding backlight sub-region, and the data signal is not compensated) for a certain sub-display area (e.g. a sub-display area whose corresponding backlight sub-region is not to subjected to peak driving), where the maximum luminance corresponding to the highest gray scale A is BLstan. The curve c shown in FIG. 4 with a bold solid line represents the relationship between the gray scale and the luminance in the case where peak driving is performed for the backlight sub-region to which the third sub-display area corresponds and the data signal supplied to the third sub-display area is compensated. The curve b represents the relationship between the gray scale and the luminance in the case where peak driving is performed for the backlight sub-region to which the third sub-display area corresponds but the data signal is not compensated. The curve a in FIG. 3 is also shown in FIG. 4. It can be seen from the curve b that, as compared to the curve a, during both the low gray scale period and the high gray scale period, the luminance of the third sub-display area after the backlight sub-region thereof has been subjected to peak driving is much higher than the luminance of the sub-display areas to which the backlight sub-regions not subjected to peak driving correspond. However, since the sensitivity of the human eyes to a luminance difference during the low gray scale period is obvious, only performing peak driving for the backlight sub-region to which the third sub-display area corresponds while not compensating the data signal easily causes a decrease in uniformity of the visual brightness, which is detrimental to the quality of the image displayed by the display device. It can be seen from the curve c that, during the low gray scale period in which the data signal is lower than $D_t$, the luminance of the third sub-display area is almost the same as the luminance of other sub-display areas to which the backlight sub-regions not subjected to peak driving correspond, and during the high gray scale period, the luminance thereof can rise to a peak luminance BLpeak. Therefore, on the basis of performing peak driving for the backlight sub-region to which the third sub-display area corresponds, adjusting the data signal for the third sub-display area by a data signal compensation circuit can significantly improve the luminance uniformity between the third sub-display area and other sub-display areas having lower luminance during the low gray scale period, while enabling the third sub-display area to exhibit a peak luminance during the high gray-scale period.

According to another embodiment of the present disclosure, data signal compensation can be further performed for the sub-display areas to which backlight sub-regions not subjected to peak driving correspond. That is, this embodiment of the present disclosure can further reduce the difference in luminance between the sub-display areas to which the backlight sub-regions not subjected to peak driving correspond and the sub-display areas to which the backlight sub-regions that have been subjected to peak driving correspond. Consequently, this embodiment can further improve the uniformity of the overall luminance of the displayed image of the display device and improve the visual effect of the displayed image.

In some embodiments, the sub-display areas to which the backlight sub-regions not subjected to peak driving correspond may include a fourth sub-display area. The fourth sub-display area has an average luminance value smaller than the first luminance threshold and includes N4 pixels whose luminance exceeds the second luminance threshold, N4 being smaller than the preset number threshold N0. The method further comprises compensating the data signal for the fourth sub-display area by a second data signal compensation circuit so as to adjust the light transmittance of the fourth sub-display area.

In some embodiments, the data signal D for the fourth sub-display area may be adjusted to $D/K_2$ by the second data signal compensation circuit, where $K_2$ is obtained by the following equation:

$$BL_2 = BL_0 \cdot K_2^{\gamma}$$

$BL_2$ is a backlight luminance of a backlight sub-region corresponding to the fourth sub-display area after backlight adjustment, $BL_0$ is a default backlight luminance of a backlight sub-region corresponding to any sub-display area of the display device without backlight adjustment, and $\gamma$ is a physical parameter of the display device which characterizes a distortion of an output image with respect to an input signal.

Referring to FIG. 2 again, in some embodiments, the step of determining whether or not to perform peak driving for respective backlight sub-regions of the display device may further comprise the following steps: S14, calculating a power P1 required for peak driving of a backlight sub-region that is determined to be subjected to peak driving; S15, comparing the required power P1 with a power threshold P0, and when the required power P1 is smaller than the power threshold P0, peak driving is performed for the backlight sub-region that is determined to be subjected to peak driving, the power threshold P0 is a power difference between a rated power or maximum power of the display device and a power required by the display device for displaying a one-frame image. In this embodiment, since peak driving is performed for the backlight sub-region that is determined to be subjected to peak driving only when the required power P1 is smaller than the power threshold P0, an additional power consumption amount the display device is able to withstand currently can be fully considered, which can prevent the actual power consumption of the display device from going beyond the rated power or maximum power, effectively ensure the security of the display device, protect the display device against damage, and facilitate extension of the service life of the display device.

Another embodiment of the present disclosure provides a control apparatus for a display device. Referring to FIG. 5 again, the display device according to an embodiment of the present disclosure may comprise a control apparatus 1, a display panel 2, and a backlight module 3. Examples of the display device include, but are not limited to, a liquid crystal display. As mentioned above, in terms of controlling the display panel 2, the display area of the display panel 2 can be divided into a plurality of sub-display areas SAs, and the backlight module 3 can be divided into a plurality of sub-backlight sub-regions. The control apparatus 1 provided by the embodiment of the present disclosure can apply a peak driving technique to the display device, that is, by analyzing the current luminance levels of respective sub-display areas SAs and selecting backlight sub-regions SB suitable for peak driving, some sub-display areas achieve a higher visual brightness to make the details of the displayed image clearer, which facilitates enhancing the contrast of the displayed image.

As shown in FIG. 5, the control apparatus 1 of the display device according to the embodiment of the present disclosure comprises a peak driving circuit 10, which may be disposed in the backlight module 3 of the display device for determining whether or not to perform peak driving for respective backlight sub-regions SBs, and performing peak driving for the backlight sub-regions SBs which are determined to be subjected to peak driving, the backlight sub-regions SBs being corresponding to the sub-display areas SAs of the display device, and a data signal compensation circuit 11 which may be disposed in the display panel 2 for performing, based on the determination result of the peak driving circuit 10, data signal compensation at least for sub-display areas whose average luminance values are lower than the preset first luminance threshold among the sub-display areas to which the backlight sub-regions determined to be subjected to peak driving correspond.

In some embodiments, the peak driving circuit 10 may take into account the current luminance levels of respective sub-display areas upon determining whether or not to perform peak driving for respective backlight sub-regions of the display device. For example, the peak driving circuit 10 may determine whether or not to perform peak driving for the backlight sub-regions to which respective sub-display areas correspond based on the average luminance of the respective sub-display areas SAs or the number of pixels included by the respective sub-display areas SAs whose luminance exceed the preset second luminance threshold.

Figure 6:
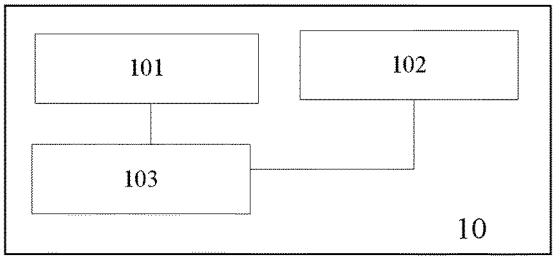
FIG. 6 illustrates a block diagram of a peak driving module in the control apparatus for the display device according to an embodiment of the present disclosure.

FIG. 6 shows a block diagram of the peak driving circuit 10 in the control apparatus 1 according to an embodiment of the present disclosure. As shown in FIG. 6, the peak driving circuit 10 may comprise a statistics module 101 for counting the number of pixels included in each sub-display area whose luminance exceed the second luminance threshold, an average luminance value calculation module 102 for calculating an average luminance value of each sub-display area, and a determination module 103 for determining backlight sub-regions to be subjected to peak driving based on the result from the statistics module 101 or the average luminance value calculation module 102. In some embodiments, the statistics module 101 may comprise an operation circuit, a comparison circuit, a counting circuit, etc. For example, the operation circuit may calculate the luminance values of pixels in each sub-display area, the comparison circuit may compare the luminance value of each pixel with the second luminance threshold, and on this basis, the counting circuit may obtain the number of pixels included in each sub-display area whose luminance exceed the second luminance threshold. The average luminance value calculation module 102 may comprise an accumulator and a division circuit. For example, the accumulator may accumulate the luminance values of all the pixels of a sub-display area to obtain the sum of luminance values of the sub-display area, and then the division circuit may divide the obtained sum of luminance values by the number of pixels within the sub-display area, thereby obtaining an average luminance value of the sub-display area. The determination module 103 may comprise a comparison circuit. The comparison circuit may compare the average luminance value of each sub-display area with the first luminance threshold and compare the number of pixels included in each sub-display area whose luminance exceed the second luminance threshold with the number threshold N0 so as to select or determine a sub-display area whose corresponding backlight sub-region is to be subjected to peak driving from the respective sub-display areas of the display device. In another example, the determination module 103 may further comprise a memory. The memory may at least store the locations or addresses of the sub-display areas to which the backlight sub-regions to be subjected to peak driving correspond, and the peak driving circuit 10 may perform peak driving for the corresponding backlight sub-regions based on the stored locations or addresses. It is to be understood that in the embodiment of the present disclosure, the peak driving circuit 10 may comprise not only the statistics module 101, the average luminance value calculation module 102 and the determination module 103 as described above, but also other functional modules such as a current driving circuit for supplying a current to the light emitting elements in the backlight sub-region of the display device, a current-regulating circuit capable of regulating the current supplied to the light emitting elements, and the like.

In some embodiments, the determination module may determine that peak driving is performed for backlight sub-regions to which a first sub-display area, a second sub-display area and a third sub-display area of the display device correspond. The first sub-display area has an average luminance value greater than the preset first luminance threshold and includes N1 pixels whose luminance exceed the second luminance threshold, N1 being greater than a preset number threshold N0. The second sub-display area has an average luminance value greater than the first luminance threshold and includes N2 pixels whose luminance exceed the second luminance threshold, N2 being smaller than the preset number threshold N0. The third sub-display area has an average luminance value smaller than the first luminance threshold and includes N3 pixels whose luminance exceeds the second luminance threshold, N3 being greater than the preset number threshold N0. It is to be understood that the second luminance threshold may be numerically equal to or may not be equal to the first luminance threshold. It is reasonable to select the backlight sub-region to which the sub-display area having a higher current average luminance or including a large number of pixels having high luminance corresponds for peak driving, because the current overall luminance level of such sub-display areas is closer to the desired maximum luminance.

In an embodiment of the present disclosure, as shown in FIG. 5, the data signal compensation circuit 11 may comprise a first data signal compensation circuit 110 for compensating the data signal for the third sub-display area so as to adjust the light transmittance of the third sub-display area.

In an embodiment, for a data signal D to the third sub-display area which is smaller than a preset data signal threshold $D_t$, the first data signal compensation circuit 110 adjusts the data signal D to $D/K_1$. For a data signal D to the third sub-display area which is greater than the data signal threshold $D_t$, the first data signal compensation circuit 110 adjusts the data signal D to $$\frac{\frac{D_t}{K_1} - A}{D_t - A}(D - A) + A$$

where A represents the highest gray scale of a displayed image of the display device, for example, A may be equal to 255, the value $K_1$ is obtained by the following equation:

$$BL_1 = BL_0 \cdot K_1^{\gamma}$$

where $BL_1$ is a backlight luminance of a backlight sub-region corresponding to the third sub-display area after backlight adjustment, $BL_0$ is a default backlight luminance of a backlight sub-region corresponding to any sub-display area of the display device without backlight adjustment, and γ is a physical parameter of the display device which characterizes a distortion of an output image with respect to an input signal. γ may vary depending on the types or models of different display devices, for example, γ may be equal to 2.2, 2.5, and so on.

That is, the data signal $D_{new}$ for the third sub-display area of the display device which has been adjusted by the first data signal compensation circuit can be represented by the following formula:

$$D_{new} = \begin{cases} D/K_1 & D < D_t \\ \frac{\frac{D_t}{K_1} - A}{D_t - A}(D - A) + A & D > D_t \end{cases}$$

As discussed above, in the case of performing peak driving for he backlight sub-region to which the third sub-display area corresponds, by adjusting the data signal to the third sub-display area in this way, the luminance uniformity between the third sub-display area and the sub-display area to which the backlight sub-region not subjected to peak driving corresponds can be improved during the low gray scale period. In addition, during the high gray scale period, the third sub-display area can exhibit a high luminance to achieve the advantages of peak driving.

In some embodiments, the data signal compensation circuit 11 may also perform data signal compensation for the sub-display areas to which the backlight sub-regions not subjected to peak driving correspond. As a result, the uniformity of the overall luminance of the displayed image of the display device can be further improved from another aspect, improving the visual effect of the displayed image. For example, according to an embodiment of the present disclosure, the sub-display areas to which backlight sub-regions not subjected to peak driving correspond include a fourth sub-display area. The fourth sub-display area has an average luminance value smaller than the first luminance threshold and includes N4 pixels whose luminance exceed the second luminance threshold, N4 being smaller than the preset number threshold N0. In this embodiment, the data signal compensation circuit 11 may compensate the data signal to the fourth sub-display area based on the determination result of the peak driving circuit 10. While for the first sub-display area and the second sub-display area having an average luminance value greater than the first luminance threshold, the two types of sub-display areas can be considered as relatively bright sub-display areas, so peak driving may be performed without data signal compensation. In this way, the overall luminance thereof can be further enhanced while the definition of the details of these sub-display areas can be further improved. Of course, in other embodiments, it is also possible to perform data signal compensation for the first sub-display area and the second sub-display area, which is more advantageous to the uniformity of the overall luminance of the displayed image of the display device. Therefore, in some embodiments of the present disclosure, as shown in FIG. 5, the data signal compensation circuit 11 may comprise a second data signal compensation circuit 111 for compensating the data signal to the fourth sub-display area so as to adjust the light transmittance of the four sub-display area.

Although the circuit that performs data signal compensation for the third sub-display area and the circuit that performs data signal compensation for the fourth sub-display area are implemented independently as the first data signal compensation circuit 110 and second data signal compensation circuit 111 in the embodiment shown in FIG. 5, in other embodiments, it is also possible to implement the circuits that perform data signal compensation for all the sub-display areas in need of data signal compensation in one piece.

In some embodiments, the second data signal compensation circuit 111 may adjust the data signal D for the fourth sub-display area to $D/K_2$, where $K_2$ is obtained by the following equation:

$$BL_2 = BL_0 \cdot K_2^{\gamma}$$

where $BL_2$ is a backlight luminance of a backlight sub-region corresponding to the fourth sub-display area after backlight adjustment, $BL_0$ is a default backlight luminance of a backlight sub-region corresponding to any sub-display area of the display device without backlight adjustment, and γ is a physical parameter of the display device which characterizes a distortion of an output image with respect to an input signal.

Figure 7:
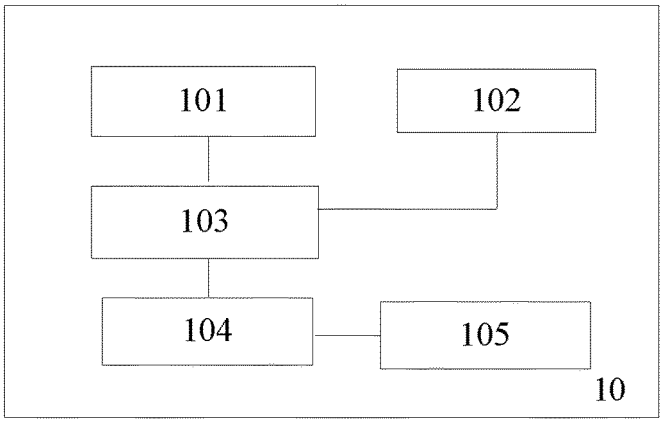
FIG. 7 illustrates a block diagram of a peak driving module in the control apparatus for the display device according to another embodiment of the present disclosure.

FIG. 7 illustrates a block diagram of a peak driving circuit 10 according to some other embodiments of the present disclosure. As shown in FIG. 7, the peak driving circuit 10 may further comprise a power calculation module 104 for calculating a power P1 required for peak driving of a backlight sub-region that is determined to be subjected to peak driving, and a comparison module 105 for comparing the required power P1 with a power threshold P0. When the required power P1 is smaller than the power threshold P0, the peak driving circuit 10 performs peak driving for the backlight sub-region that is determined to be subjected to peak driving, and the power threshold P0 is a power difference between a rated power or a maximum power of the display device and a power required by the display device for displaying a one-frame image. The power calculation module 104 may firstly calculate, based on the operating voltage of the display device and the driving current corresponding to the peak luminance of a sub-display area to which each backlight sub-region that is determined to be subjected to peak driving corresponds, a power required for peak driving of the backlight sub-region to which the sub-display area corresponds, and then accumulates the power required by each backlight sub-region that is determined to be subjected peak driving to obtain the power P1. Based on a similar principle, the power consumed by the display device currently for displaying a one-frame image can be calculated and the power threshold P0 can be further calculated based on the rated power or maximum power of the display device. In this embodiment, since the peak driving circuit 10 performs peak driving for the backlight sub-region that is determined to be subjected to peak driving only when the required power P1 is smaller than the power threshold P0, an additional power consumption amount the display device is able to withstand currently can be fully considered, which can prevent the actual power consumption of the display device from going beyond the rated power or maximum power, effectively ensure the security of the display device, protect the display device against damage, and facilitate extension of the service life of the display device.

A further embodiment of the present disclosure further provides a display device that may comprise the control apparatus as described in any one of the preceding embodiments regarding the control apparatus. It is to be understood that such a display device may be any device that can be subjected to backlight adjustment and has display function, including, but not limited to, a liquid crystal display, a television, a mobile phone, a tablet computer, a player, a navigator, and the like.

The control apparatus for the display device as described in the embodiments of the present disclosure may be implemented in various hardware forms. For example, the function of the control apparatus can be realized by programming a field programmable gate array (FPGA) chip. Alternatively, it can also be realized using a programmable microprocessor or integrated circuit chip in combination with a peripheral circuit. Specific steps of the method for controlling the display device as described in the preceding embodiments of the present disclosure can be carried out by programming using various computer languages. In addition, the control apparatus for the display device and the method for controlling the display device as described in the preceding embodiments can also be realized by software programming in combination with hardware circuits.

While the embodiments of the present disclosure have been described in detail with reference to the accompanying drawings, it is to be noted that the above-described embodiments are intended to illustrate and not limit the present invention, and those skilled in the art will be able to design many alternative embodiments without departing from the scope of the appended claims. In the claims, the word "comprising" does not exclude other elements or steps than those enumerated in the claims, and the indefinite article "a" or "an" does not exclude a plurality. The mere fact that certain measures are recited in mutually different dependent claims does not indicate that a combination of these measures cannot be used to advantage.

The invention claimed is:

1. A method for controlling a display device, comprising:

determining whether or not to perform peak driving for respective backlight sub-regions of the display device, the backlight sub-regions corresponding to sub-display areas of the display device; and performing, in response to a result of the above determining, data signal compensation at least for sub-display areas whose average luminance values are lower than a first luminance threshold among the sub-display areas to which the backlight sub-regions that are determined to be subjected to peak driving correspond, wherein determining whether or not to perform peak driving for respective backlight sub-regions of the display device comprises:

counting the number of pixels included in each sub-display area whose luminance exceed the second luminance threshold, calculating an average luminance value of each sub-display area, determining backlight sub-regions to be subjected to peak driving based on a result of the above counting step or calculating step, wherein the method further comprises:

determining that peak driving is performed for backlight sub-regions to which a first sub-display area, a second sub-display area and a third sub-display area of the display device correspond, wherein the first sub-display area has an average luminance value greater than the first luminance threshold and includes N1 pixels whose luminance exceed the second luminance threshold, N1 being greater than a preset number threshold N0, the second sub-display area has an average luminance value greater than the first luminance threshold and includes N2 pixels whose luminance exceed the second luminance threshold, N2 being smaller than the preset number threshold N0, the third sub-display area has an average luminance value smaller than the first luminance threshold and includes N3 pixels whose luminance exceed the second luminance threshold, N3 being greater than the preset number threshold N0.

2. The method according to claim 1, wherein the method comprises:

compensating a data signal to the third sub-display area by a first data signal compensation circuit so as to adjust light transmittance of the third sub-display area.

3. The method according to claim 2, wherein for a data signal D to the third sub-display area which is smaller than a preset data signal threshold $D_t$, the data signal D is adjusted to $D/K_1$ by the first data signal compensation circuit, for a data signal D to the third sub-display area which is greater than the data signal threshold $D_t$, the data signal D is adjusted to $$\frac{\frac{D_t}{K_1} - A}{D_t - A}(D - A) + A$$

by the first data signal compensation circuit, wherein A represents the highest gray scale of a displayed image of the display device, the value $K_1$ is obtained by the following equation:

$$BL_1 = BL_0 . K_1^{\gamma}$$

wherein $BL_1$ is a backlight luminance of a backlight sub-region corresponding to the third sub-display area after backlight adjustment, $BL_0$ is a default backlight luminance of a backlight sub-region corresponding to any sub-display area of the display device without backlight adjustment, $\gamma$ is a physical parameter of the display device which characterizes a distortion of an output image with respect to an input signal.

4. The method according to claim 1, wherein the method further comprises:

performing data signal compensation for sub-display areas of the display device to which backlight sub-regions not subjected to peak driving correspond.

5. The method according to claim 4, wherein the sub-display areas to which backlight sub-regions not subjected to peak driving correspond includes a fourth sub-display area, the fourth sub-display area having an average luminance value smaller than the first luminance threshold and including N4 pixels whose luminance exceed the second luminance threshold, N4 being smaller than the preset number threshold N0, wherein the method further comprises compensating a data signal to the fourth sub-display area by a second data signal compensation circuit so as to adjust light transmittance of the fourth sub-display area.

6. The method according to claim 5, wherein a data signal D to the fourth sub-display area is adjusted to $D/K_2$ by the second data signal compensation circuit, wherein $K_2$ is obtained by the following equation:

$$BL_2=BL_0.K_2^{\gamma}$$

wherein $BL_2$ is a backlight luminance of a backlight sub-region corresponding to the fourth sub-display area after backlight adjustment, $BL_0$ is a default backlight luminance of a backlight sub-region corresponding to any sub-display area of the display device without backlight adjustment, $\gamma$ is a physical parameter of the display device which characterizes a distortion of an output image with respect to an input signal.

7. The method according to claim 1, wherein the step of determining whether or not to perform peak driving for respective backlight sub-regions of the display device further comprises:

calculating a power P1 required for peak driving of a backlight sub-region that is determined to be subjected to peak driving, and comparing the required power P1 with a power threshold P0, wherein when the required power P1 is smaller than the power threshold P0, peak driving is performed for the backlight sub-region that is determined to be subjected to peak driving, and the power threshold P0 is a power difference between a rated power or a maximum power of the display device and a power required by the display device for displaying one frame image.

8. A control apparatus for a display device, comprising:

a peak driving circuit in a backlight module for determining whether or not to perform peak driving for respective backlight sub-regions and performing peak driving for a backlight sub-region that is determined to be subjected to peak driving, the backlight sub-regions corresponding to sub-display areas of the display device; and a data signal compensation circuit in a display panel for performing, based on a determination result from the peak driving circuit, data signal compensation at least for sub-display areas whose average luminance values are lower than a first luminance threshold among the sub-display areas to which the backlight sub-regions that are determined to be subjected to peak driving correspond, wherein the peak driving circuit comprises:

a statistics module for counting the number of pixels included in each sub-display area whose luminance exceed the second luminance threshold;

an average luminance value calculation module for calculating an average luminance value of each sub-display area;

a determination module for determining backlight sub-regions to be subjected to peak driving based on a result from the statistics module or the average luminance value calculation module, wherein the determination module determines that peak driving is performed for backlight sub-regions to which a first sub-display area, a second sub-display area and a third sub-display area of the display device correspond, wherein the first sub-display area has an average luminance value greater than the first luminance threshold and includes N1 pixels whose luminance exceed the second luminance threshold, N1 being greater than a preset number threshold N0, the second sub-display area has an average luminance value greater than the first luminance threshold and includes N2 pixels whose luminance exceed the second luminance threshold, N2 being smaller than the preset number threshold N0, the third sub-display area has an average luminance value smaller than the first luminance threshold and includes N3 pixels whose luminance exceed the second luminance threshold, N3 being greater than the preset number threshold N0.

9. The control apparatus according to claim 8, wherein the data signal compensation circuit comprises:

a first data signal compensation circuit for compensating a data signal to the third sub-display area so as to adjust light transmittance of the third sub-display area.

10. The control apparatus according to claim 9, wherein for a data signal D to the third sub-display area which is smaller than a preset data signal threshold $D_t$, the first data signal compensation circuit adjusts the data signal D to $D/K_1$, for a data signal D to the third sub-display area which is greater than the data signal threshold $D_t$, the first data signal compensation circuit adjusts the data signal D to $$\frac{\frac{D_t}{K_1}-A}{D_t-A}(D-A)+A$$

wherein A represents the highest gray scale of a displayed image of the display device; the value $K_1$ is obtained by the following equation:

$$BL_1=BL_0.K_1^{\gamma}$$

wherein $BL_1$ is a backlight luminance of a backlight sub-region corresponding to the third sub-display area after backlight adjustment, $BL_0$ is a default backlight luminance of a backlight sub-region corresponding to any sub-display area of the display device without backlight adjustment, $\gamma$ is a physical parameter of the display device which characterizes a distortion of an output image with respect to an input signal.

11. The control apparatus according to claim 8, wherein the data signal compensation circuit further performs data signal compensation for sub-display areas of the display device to which backlight sub-regions not subjected to peak driving correspond.

12. The control apparatus according to claim 11, wherein the sub-display areas to which backlight sub-regions not subjected to peak driving correspond includes a fourth sub-display area, the fourth sub-display area having an average luminance value smaller than the first luminance threshold and including N4 pixels whose luminance exceed the second luminance threshold, N4 being smaller than the preset number threshold N0, wherein the data signal compensation circuit comprises a second data signal compensation circuit for compensating a data signal to the fourth sub-display area so as to adjust light transmittance of the fourth sub-display area.

13. The control apparatus according to claim 12, wherein the second data signal compensation circuit adjusts the data signal D to the fourth sub-display area to $D/K_2$, wherein $K_2$ is obtained by the following equation:

$$BL_2 = BL_0 \cdot K_2^{\gamma}$$

wherein $BL_2$ is a backlight luminance of a backlight sub-region corresponding to the fourth sub-display area after backlight adjustment, $BL_0$ is a default backlight luminance of a backlight sub-region corresponding to any sub-display area of the display device without backlight adjustment, $\gamma$ is a physical parameter of the display device which characterizes a distortion of an output image with respect to an input signal.

14. The control apparatus according to claim 8, wherein the peak driving circuit further comprises:

a power calculation module for calculating a power P1 required for peak driving of a backlight sub-region that is determined to be subjected to peak driving;

a comparison module for comparing the required power P1 with a power threshold P0;

wherein when the required power P1 is smaller than the power threshold P0, the peak driving circuit performs peak driving for the backlight sub-region that is determined to be subjected to peak driving, and the power threshold P0 is a power difference between a rated power or a maximum power of the display device and a power required by the display device for displaying one frame image.

* * * * *